US005481161A

United States Patent [19]

El-Hamamsy et al.

[11] Patent Number: 5,481,161

[45] Date of Patent: Jan. 2, 1996

[54] VARIABLE FREQUENCY GENERATOR FOR RESONANT POWER FEEDBACK

[75] Inventors: Sayed-Amr El-Hamamsy; Mustansir H. Kheraluwala, both of Schenectady, N.Y.

[73] Assignee: General Electric Company, Schenectady, N.Y.

[21] Appl. No.: 386,570

[22] Filed: Feb. 10, 1995

[51] Int. Cl.[6] ..... H05B 37/02

[52] U.S. Cl. ..... 315/224; 315/247; 327/172; 327/175; 327/541; 331/177 R

[58] Field of Search ..... 327/172, 175, 327/334, 541, 543; 331/177 R; 315/247, 224, 225

[56] References Cited

U.S. PATENT DOCUMENTS

| | | | |
|---|---|---|---|
| 3,956,713 | 5/1976 | Ogawara | 331/113 R |
| 4,823,070 | 4/1989 | Nelson | 323/285 |
| 5,012,161 | 4/1991 | Borowiec et al. | 315/247 |
| 5,083,043 | 1/1992 | Yoshida | 327/541 X |
| 5,373,477 | 12/1994 | Sugibayashi | 327/541 X |

OTHER PUBLICATIONS

"555 Timer Applications Sourcebook, with Experiments" by Howard M. Berlin, 1978, pp. 27–33, 35 & 36.

Serial No. 08/386,572, "Multi–Resonant Boost For High Power Factor Circuit," S–A El–Hamamsy et al., filed Feb. 10, 1995.

*Primary Examiner*—Robert J. Pascal

*Assistant Examiner*—Haissa Philogene

*Attorney, Agent, or Firm*—Jill M. Breedlove; Marvin Snyder

[57] ABSTRACT

A fixed duty ratio, variable frequency, square wave generator includes an astable multivibrator having a pair of resistors coupled in series between a supply voltage terminal and a capacitor, such as of a type implemented with a 555 timer, and further includes a JFET connected between the capacitor and ground. In a current-controlled version, the anode of a diode is connected to the gate of the JFET, and the cathode of the diode is connected to a sensing resistor for sensing current in a load. The multivibrator generates a ramp voltage across the capacitor which varies between predetermined fractions of the supply voltage with a fixed duty ratio. The capacitor of the multivibrator charges and discharges through the series connection of the resistors and the JFET channel resistance with charging and discharging times that vary with the input voltage to the JFET, thereby varying the generator frequency.

13 Claims, 5 Drawing Sheets

VARIABLE FREQUENCY GENERATOR FOR RESONANT POWER FEEDBACK

FIELD OF THE INVENTION

The present invention relates generally to feedback control in resonant power circuits and, more particularly, to a current-controlled or voltage-controlled variable frequency generator using a 555 timer.

BACKGROUND OF THE INVENTION

Resonant power circuits, such as lamp ballasts, commonly use frequency as the main control variable for maintaining output current or voltage constant or, in the case of dimming circuits, for changing output current or voltage. For some high power factor ballast circuits, e.g., well-known valley fill circuits, such as of a type described in U.S. Pat. No. 5,012,161 of J. C. Borowiec and S-A El-Hamamsy, issued Apr. 30, 1991, the current in the lamp is modulated by the bus voltage. In order to meet the specifications for lamp life, the lamp current crest factor has to be less than about 1.7. The lamp current crest factor (ccf) is defined as the ratio of peak current to rms current; an unmodulated sine wave has a crest factor of 1.414. A simple, economical circuit that controls the lamp current is therefore needed in order to meet lamp life specifications.

Specialized integrated circuits (IC's) use voltage-controlled oscillators (VCO's) for generating variable frequency drive signals. Disadvantageously, however, such circuits are typically too expensive to use in very low-cost applications, such as, for example, compact fluorescent lamp ballasts.

Accordingly, it is desirable to provide a variable frequency generator for use in the feedback loop of resonant power circuits, such as, for example, lamp ballasts or other applications in which either the current or voltage of a resonant switching converter is controlled by varying the switching frequency such as, for example, off-line power supplies and dc-to-dc converters. It is also desirable to provide a fixed duty ratio, variable frequency, current-controlled or voltage-controlled square wave gate drive in an IC with a minimal number of circuit components. Such a controller should have a high gain so that error in the output is minimized.

SUMMARY OF THE INVENTION

A fixed duty ratio, variable frequency, square wave generator comprises an astable multivibrator including a pair of resistors coupled in series between a supply voltage terminal and a capacitor, such as of a type implemented with a 555 timer, and further comprises an electrically controllable variable resistor, such as a JFET or a MOSFET, connected between the capacitor and ground. In a current-controlled version wherein the sensed current is ac, the anode of a diode is connected to the gate of the JFET, and the cathode of the diode is connected to a sensing resistor for sensing current in a load connected thereto. Alternatively, a voltage sensor for sensing voltage across the load is used in a voltage-controlled system.

The multivibrator generates a ramp voltage across the capacitor which varies between predetermined fractions of the supply voltage with a fixed duty ratio. The JFET has a channel resistance which varies with input voltage thereto. The capacitor of the multivibrator charges and discharges through the series connection of the resistors and the JFET channel resistance with charging and discharging times that vary with the input voltage to the JFET. In another embodiment, a resistor is coupled across the drain and source terminals of the JFET for limiting the maximum frequency of the square wave generator.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
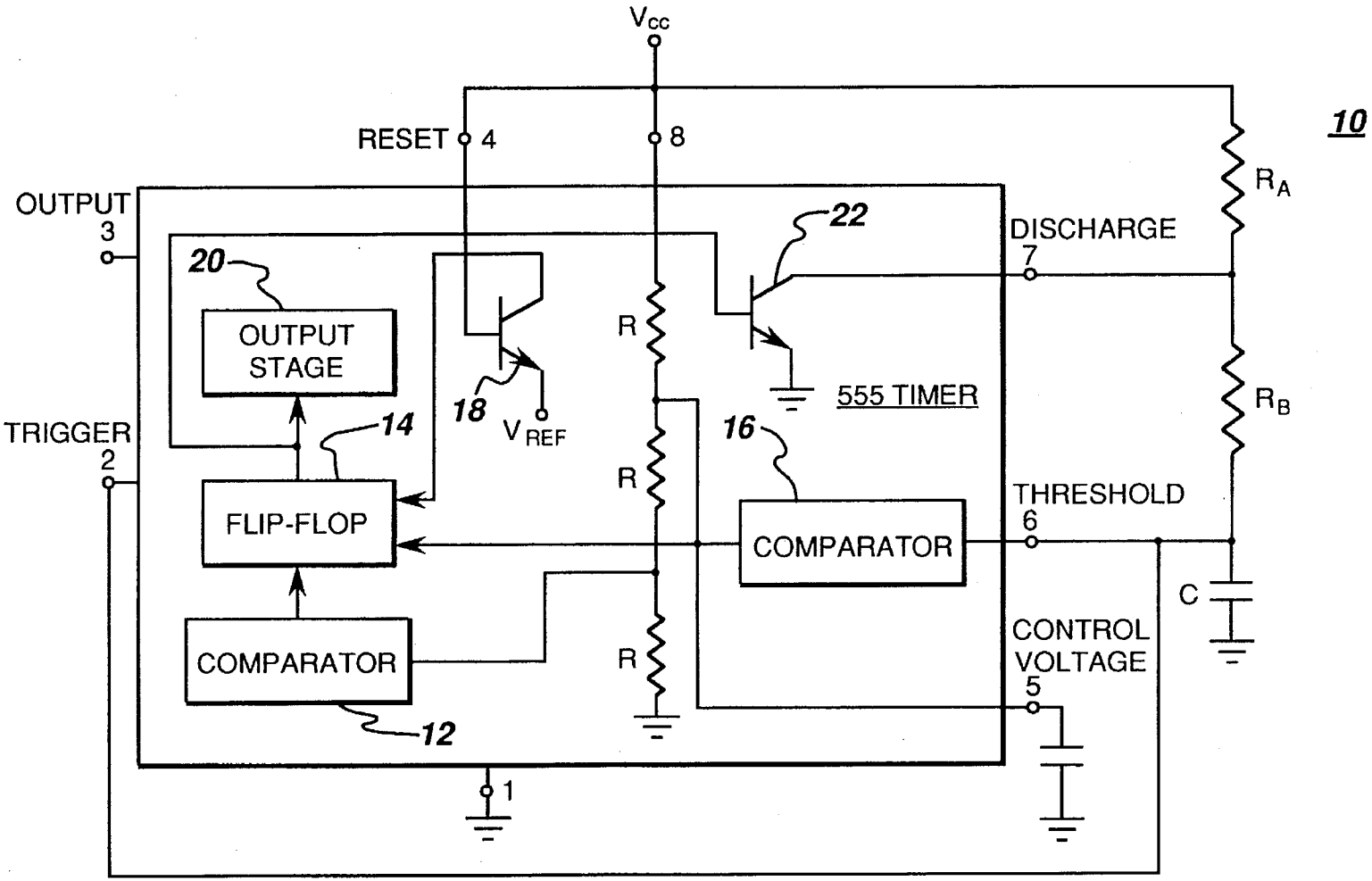
FIG. 1 schematically illustrates a conventional configuration for a well-known 555 timer, such as a LM555 Timer manufactured by National Semiconductor Corporation, as a fixed frequency, fixed duty ratio, square wave generator.

FIG. 1 illustrates a conventional configuration of a well-known astable multivibrator 10 implemented with a 555 timer. A suitable 555 timer is a LM555 Timer manufactured by National Semiconductor Corporation, but there are many available well-known versions of the 555 timer from a number of companies. Alternatively, any integrated circuit with a similar frequency generating scheme, such as a type IR2155 or a type IR2151, both manufactured by International Rectifier Corporation, can be used.

As shown in FIG. 1, a typical 555 timer includes eight pins designated as: (1) ground; (2) trigger; (3) output; (4) reset; (5) control voltage; (6) threshold; (7) discharge; and (8) supply voltage +Vcc. Within the 555 timer, three resistors R are connected between supply voltage pin 8 and ground. The trigger pin 2 and the junction between the lower two resistors R are inputs to a comparator 12, and the output of comparator 12 is provided to a flip-flop 14. Other inputs to flip-flop 14 include the output of another comparator 16 and the drain terminal of a switching device 18 coupled to reset pin 4. The inputs of comparator 16 are the threshold pin 6 and the junction between the two upper resistors R, which is also connected to control voltage pin 5. The output of flip-flop 14 is connected to an output stage 20 coupled to pin 3 and is also connected to the gate of another switching device 22, the drain of which is connected to discharge pin 7.

The multivibrator of FIG. 1 uses two resistors $R_A$ and $R_B$ and a capacitor C to determine the duty ratio and the frequency of the square wave output at pin 3. In operation, capacitor C is charged through $R_A$ and $R_B$ from the dc supply $V_{CC}$. When the voltage across capacitor C reaches $\frac{2}{3}V_{CC}$, device 22 turns on and discharges capacitor C through resistor $R_B$. The discharge period ends when the voltage across capacitor C reaches $\frac{1}{3}V_{CC}$. The charging and discharging times $t_c$ and $t_d$, respectively, are represented by the following relationships:

$$t_c=0.693(R_A+R_B)C;$$

and $$t_d=0.693R_BC.$$

The output at pin 3 is a square wave, the period of which is the sum $t_d+t_c$. The duty ratio D of the square wave is given by:

$$D=\frac{t_d}{t_c+t_d}=\frac{R_B}{R_A+2R_B}.$$

Therefore, for a duty ratio close to 0.5, $R_A$ must be much smaller than $R_B$. However, since the IC draws current through $R_A$ from the dc power supply during the discharge period, $R_A$ cannot be made equal to zero.

A 555 timer as described hereinabove has been used in timing applications for many years for generating a series of narrow pulses, or a sawtooth waveform, or a fixed frequency square wave with variable duty ratio, covering most timing applications. Hence, 555 timers have heretofore not been considered as suitable for use in fixed duty ratio, variable frequency generators.

One reason that 555 timers have not been considered suitable for use in fixed duty ratio, variable frequency applications is that, in order to control frequency using a 555 timer, either the value of capacitor C or one of the resistors $R_A$ or $R_B$ must be changed. In order to change the value of capacitor C while achieving a high voltage-to-frequency gain, a varactor with a large capacitance change relative to bias voltage is needed. However, since the voltage across the capacitor is a triangular waveform with values from $\frac{1}{3}V_{CC}$ to $\frac{2}{3}V_{CC}$, the value of capacitor C would change during the cycle. Since the variation in capacitance C due to the voltage across it would be significantly larger than the variation due to the feedback signal, such an approach would not be useful.

For another reason, although a MOSFET or a JFET could be used as a variable resistor controlled by the signal at the gate of the device, if such a device is used to vary the value of $R_A$ or $R_B$, the duty ratio would no longer remain constant. And, since the resistors are not referenced to ground potential, the signal to the gate would have to be isolated from ground. If the feedback signal were ac, then a transformer would be required for isolation. If it were dc, an opto-isolator would be needed. These solutions are impractical.

Figure 2:
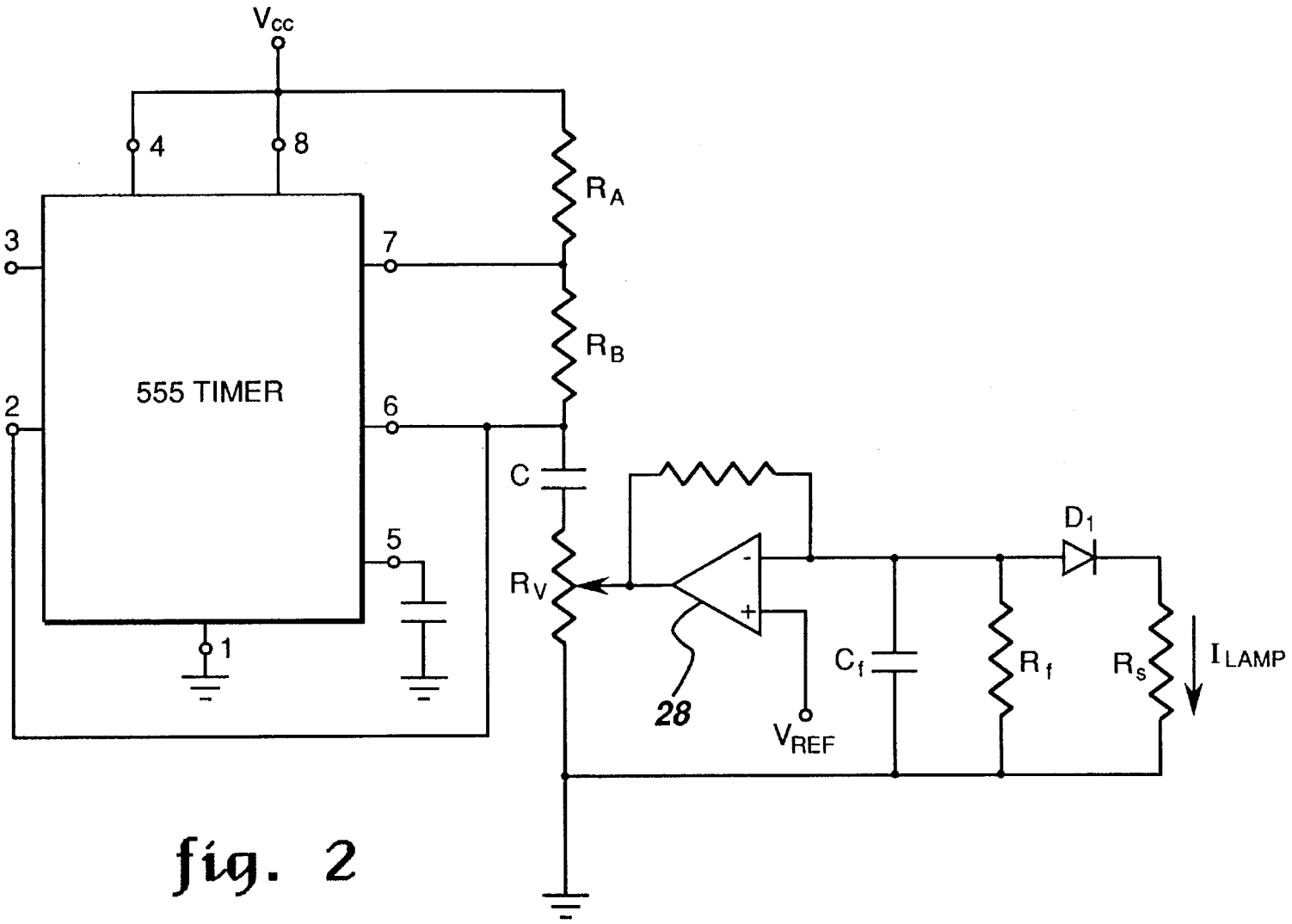
FIG. 2 schematically illustrates a 555 timer configured as a fixed duty ratio, current-controlled, variable frequency, square wave generator in accordance with the present invention.

The present invention, however, successfully utilizes a 555 timer in a novel configuration to provide a fixed duty ratio, variable frequency, current-controlled or voltage-controlled square wave generator. FIG. 2 illustrates one embodiment of a square wave generator according to the present invention in a current-controlled system. An electrically controllable variable resistance $R_v$ is situated in series with capacitor C and is referenced to ground. Resistance $R_v$ varies with input voltage thereto as applied by a high-gain error amplifier 28. The parallel combination of a capacitor $C_f$ and a resistor $R_f$, forming a low-pass filter, is connected between the inverting input of amplifier 28 and ground. The anode of a diode $D_1$ is connected to the inverting input of amplifier 28, and the cathode of $D_1$ is connected to a current-viewing resistor $R_s$. (Note that if the variable feedback is dc, there is, of course, no need to rectify and filter.)

Figure 3:
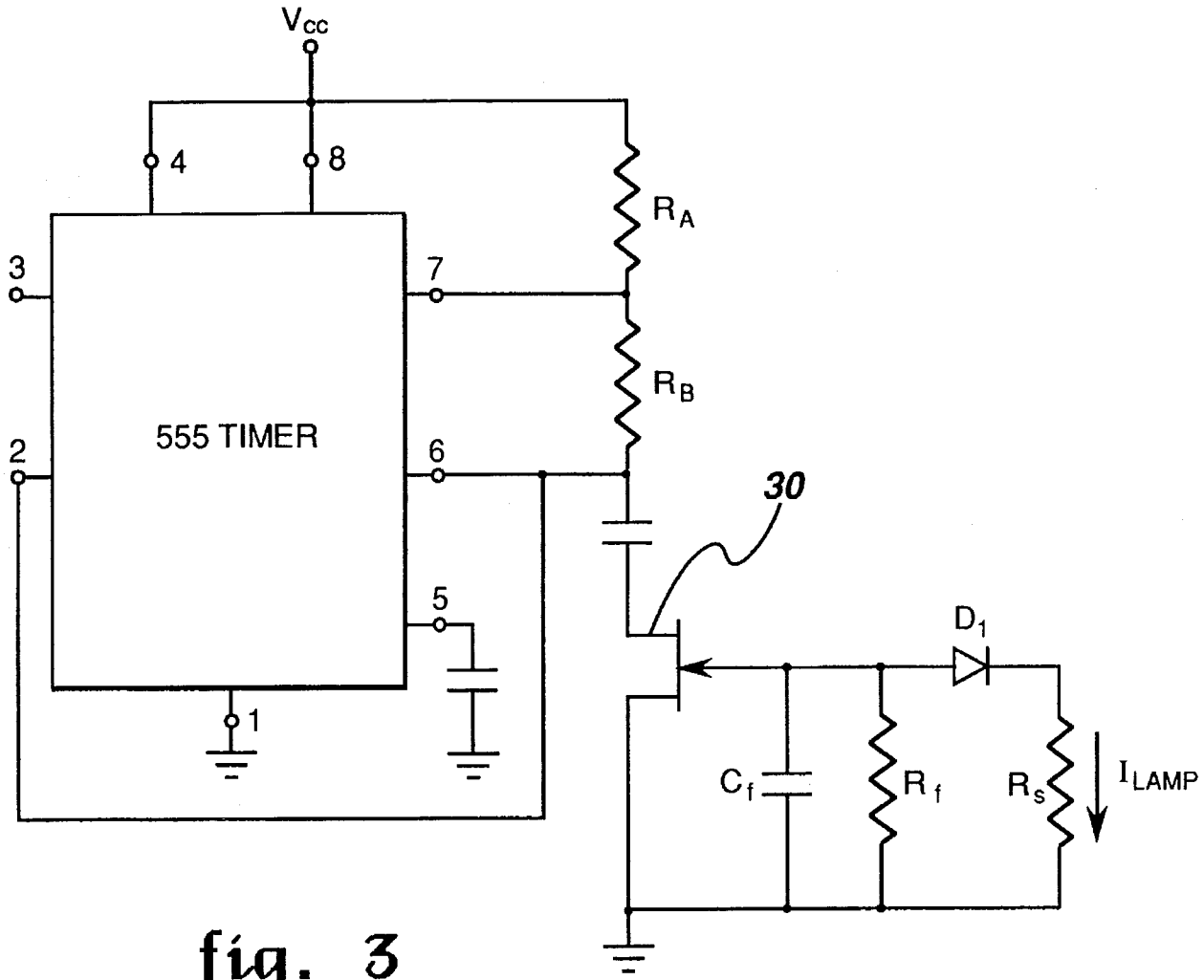
FIG. 3 schematically illustrates a 555 timer configured as a fixed duty ratio, current-controlled, variable frequency, square wave generator in accordance with an alternative embodiment of the present invention.

A preferred embodiment of a variable frequency, square wave generator according to the present invention is illustrated in FIG. 3 wherein the electrically controllable variable resistance comprises a semiconductor device having a channel resistance which varies with input voltage, shown in FIG. 3 as a JFET. A JFET is a normally-on device. However, it is to be understood that either a normally-on or a normally-off device could be used depending on whether the frequency must go up or down with an increasing feedback signal which, in turn, depends on whether the switching frequency is higher or lower than the series resonant frequency, for example. As an alternative to the JFET, a MOSFET could be used. The parallel combination of capacitor $C_f$ and resistor $R_f$, forming a low-pass filter, is connected between the gate of the JFET and ground. The anode of a diode $D_1$ is connected to the gate of the JFET, and the cathode of $D_1$ is connected to a current-viewing resistor $R_s$. (Note that if the variable feedback is dc, there is, of course, no need to rectify and filter.)

In operation, the resistance of the JFET affects both the charging and discharging cycles of capacitor C, and hence does not affect the duty ratio of the output, while still changing the frequency, as desired. The current, i.e., illustrated as a lamp current $I_{lamp}$ by way of example only, is sensed by current-viewing resistor $R_s$. The resulting ac voltage is rectified by diode $D_1$ and filtered by capacitor $C_f$. Due to the orientation of diode $D_1$, a negative voltage is impressed across capacitor $C_f$ for a depletion mode JFET, since a depletion mode device is normally on. As the current increases in the lamp, the voltage across the gate becomes more negative. This causes the JFET channel resistance to increase and the frequency of the output square wave of the 555 timer to increase. For a standard electronic ballast configuration, this results in a decrease in lamp current $I_{lamp}$. On the other hand, for a decrease in lamp current, the JFET channel resistance decreases and the frequency of the output square wave decreases. Thus, the control circuit works to maintain the peak lamp current constant. The gain of the circuit is very high since the change in resistance of the JFET for a given change in input voltage is very large.

The charging and discharging times, $t_c$ and $t_d$, respectively, for the network of FIG. 2 are:

$$t_c=\ln\left(\frac{(R_A+R_B)(2R_B-R_C)}{(R_A+R_B+R_C)R_B}\right)(R_A+R_B+R_C)C;$$

and $$t_d=\ln\left(\frac{(2R_A+2R_B-R_C)R_B}{(R_B+R_C)(R_A+R_B)}\right)(R_B+R_C)C.$$

For example, the following values of C, $R_A$, $R_B$ and $R_C$ yield a square wave with a duty ratio of 0.498 and a frequency of 71.9 kHz: C=100 pF; $R_A$=1kΩ; $R_B$=100 kΩ; and $R_C$=800 Ω. The value of $R_C$ in this example is the on-resistance of a 2N5245 JFET manufactured by National Semiconductor Corporation. This JFET is a normally-on device for which the channel resistance increases with increasing negative bias across gate-to-source of the device. If $R_C$ is increased to 28 kΩ, the frequency increases to 130.9 kHz, while the duty ratio remains the same. When the device is fully off, its resistance is on the order of millions of ohms. The voltage change needed to get the device from fully-on to 28 kΩ is about 1.8 volts. Hence, the gain of the system is very high.

FIG. 3 illustrates an alternative embodiment of the circuit of FIG. 2 with an additional resistor $R_{C1}$ coupled in series with capacitor C across the source and drain terminals of the JFET. $R_{C1}$ limits the maximum frequency of the square wave output of the 555 timer by clamping the equivalent resistance from drain-to-source of the JFET. The minimum frequency is set by the value of $R_A$ and $R_B$.

The speed of response of the circuit is determined by selecting the appropriate values for $R_f$ and $C_f$ in the circuits of FIGS. 2 and 3. The value of the sensing, or current-viewing, resistor $R_s$ affects the overall current-to-frequency gain of the system since the voltage applied to the gate of the JFET is equal to the product of the lamp current $I_{lamp}$ and $R_s$.

Figure 4:
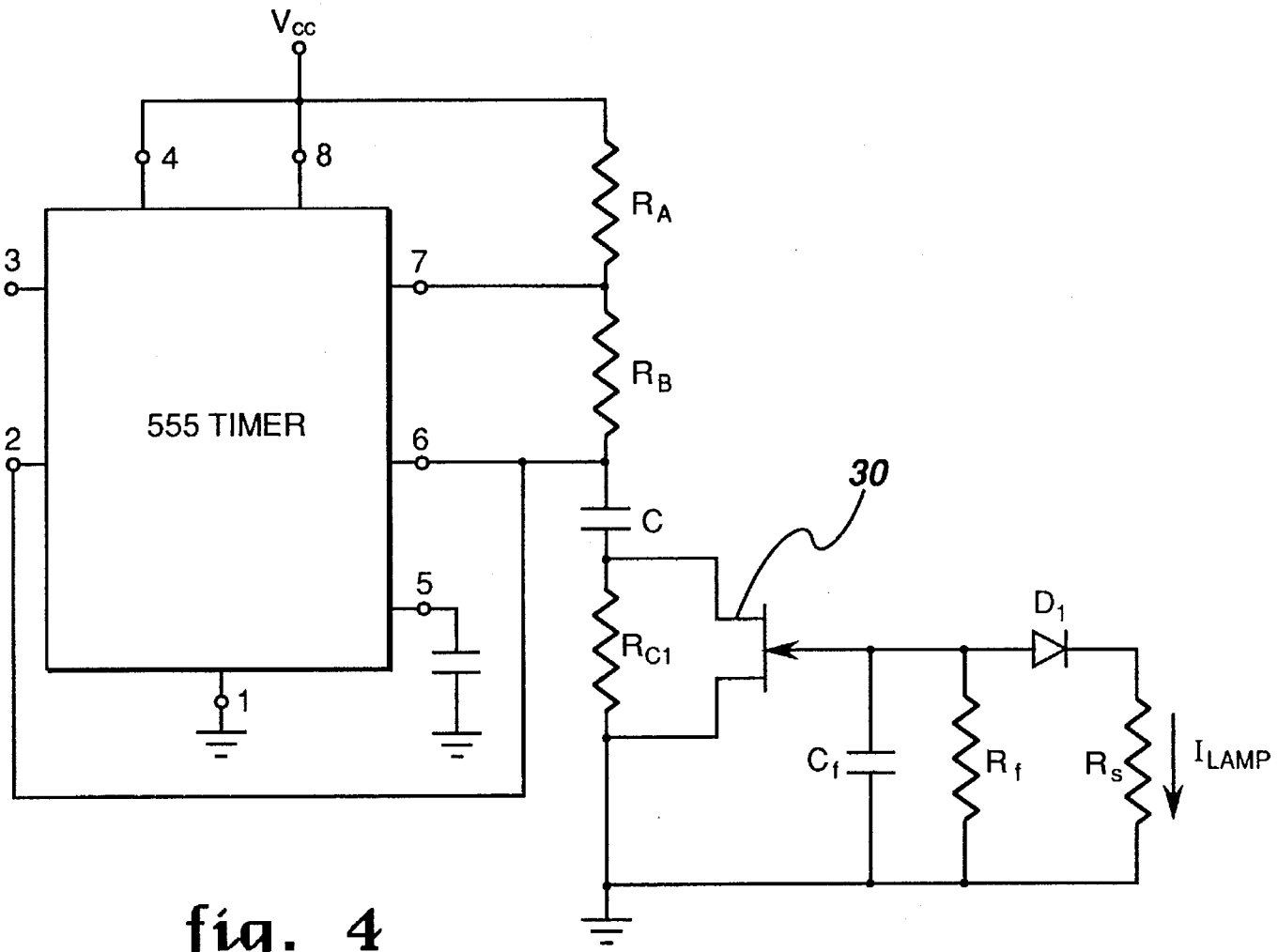
FIG. 4 schematically illustrates a 555 timer configured as a fixed duty ratio, current-controlled, variable frequency, square wave generator in accordance with an alternative embodiment of the present invention.
Figure 5:
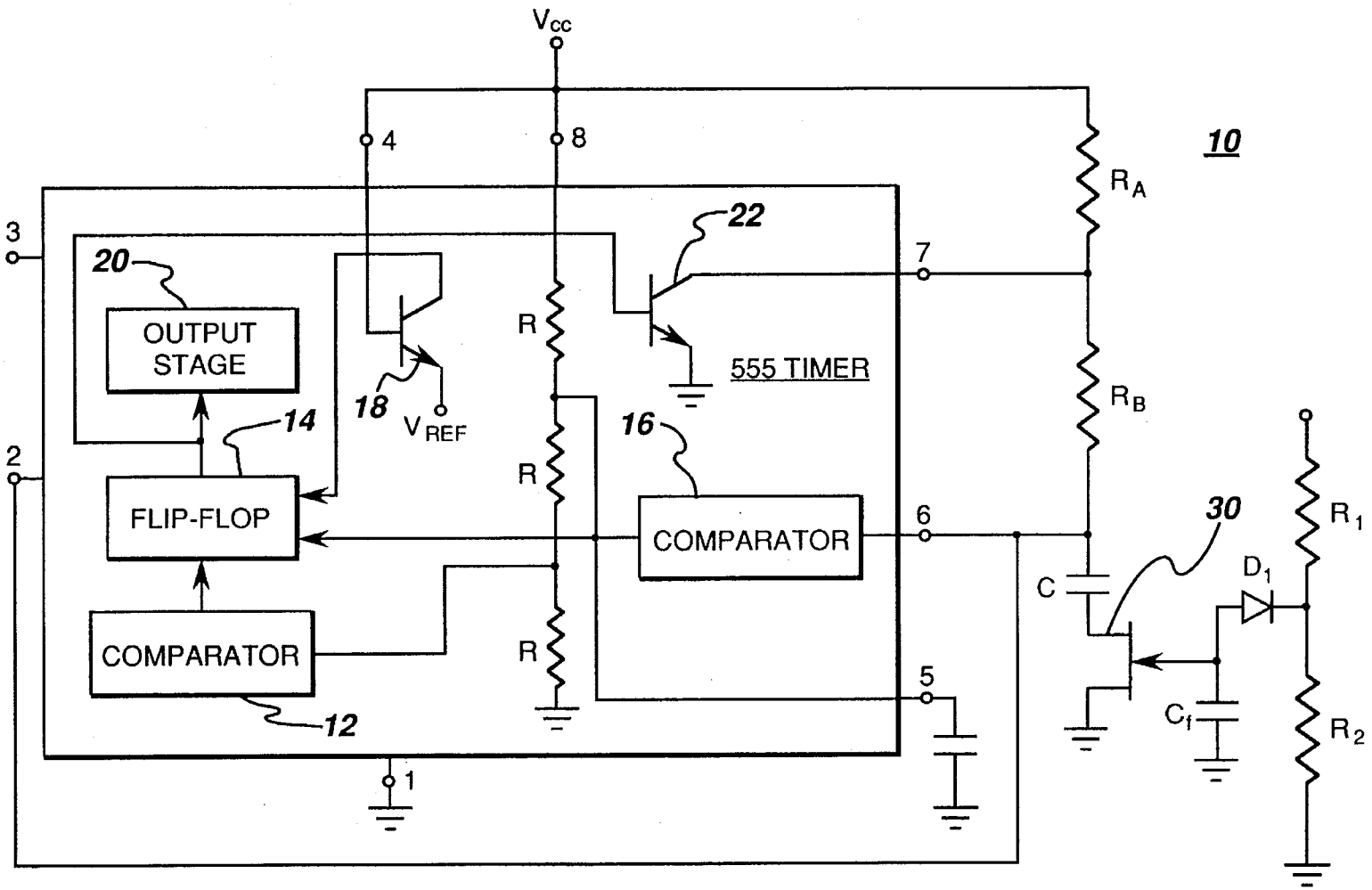
FIG. 5 schematically illustrates a 555 timer configured as a fixed duty ratio, voltage-controlled, variable frequency, square wave generator in accordance with another alternative embodiment of the present invention.

FIG. 4 illustrates a voltage-controlled version of the present invention wherein a voltage sensor 40, illustrated in FIG. 4 as comprising a voltage divider $R_1$, $R_2$ which senses the voltage to be regulated. As the voltage across $C_f$ becomes more negative, the JFET channel resistance increases (i.e., assuming a normally-on type device) and the frequency of the output square wave of the 555 timer increases.

Although the invention herein has been described with reference to a semiconductor device 30 having a channel resistance which varies with input voltage, those of ordinary skill in the art will understand that any controllable resistance that varies with input voltage may be used.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A fixed duty ratio, variable frequency, square wave generator, comprising:

an astable multivibrator including a pair of resistors coupled in series between a supply voltage terminal and a capacitor, said multivibrator generating a square wave voltage across said capacitor which varies between predetermined fractions of said supply voltage with a fixed duty ratio; and a controllable, high-gain, variable resistance connected between said capacitor and a ground potential, said variable resistance varying with input voltage thereto, said capacitor of said multivibrator charging and discharging through the series connection of said resistors and said variable resistance with charging and discharging times that vary with the input voltage thereto.

2. The variable frequency generator of claim 1 wherein said controllable, high-gain, variable resistance comprises a variable resistor coupled to a high-gain error amplifier.

3. The variable frequency generator of claim 1 wherein said controllable, high-gain, variable resistance comprises a semiconductor device.

4. The variable frequency generator of claim 3 wherein said semiconductor device is selected from a group comprising normally-on and normally-off devices.

5. The variable frequency generator of claim 3 wherein said semiconductor device is selected from a group comprising JFET's and MOSFET's.

6. The variable frequency generator of claim 1, comprising a current-controlled square wave generator, said current-controlled square wave generator further comprising a current sensor for sensing current through a load coupled thereto.

7. The variable frequency generator of claim 6 wherein said current sensor comprises a resistor.

8. The variable frequency generator of claim 6, further comprising a diode having its cathode connected to said current sensor and its anode connected to said variable resistance.

9. The variable frequency generator of claim 1, comprising a voltage-controlled square wave generator, said voltage-controlled square wave generator further comprising a voltage sensor for sensing voltage across a load coupled thereto.

10. The variable frequency generator of claim 9 wherein said voltage sensor comprises a resistive voltage divider.

11. The variable frequency generator of claim 9, further comprising a diode having its cathode connected to said voltage sensor and its anode connected to said variable resistance.

12. The variable frequency generator of claim 1, further comprising a filter coupled to said variable resistance.

13. The variable frequency generator of claim 1, further comprising a frequency-limiting resistor coupled across said variable resistance for limiting the maximum frequency of said square wave generator.

* * * * *